US005454151A

United States Patent [19]

Bogucki-Land et al.

[11] Patent Number: 5,454,151

[45] Date of Patent: Oct. 3, 1995

[54] ARRANGEMENT FOR SETTING THE TENSION OF A THREAD

[75] Inventors: Bogdan Bogucki-Land, Offenbach; Friedrich Gille, Obertshausen, both of Germany

[73] Assignee: Karl Mayer Textilmaschinenfabrik GmbH, Obertshausen, Germany

[21] Appl. No.: 271,944

[22] Filed: Jul. 8, 1994

[30] Foreign Application Priority Data

Jul. 21, 1993 [DE] Germany ..... 43 24 412.2

[51] Int. Cl.[6] ..... B65H 59/38; B65H 59/18; D04B 15/48

[52] U.S. Cl. ..... 28/194; 66/194; 226/44; 242/418.1

[58] Field of Search ..... 66/132 R; 28/194; 226/44; 242/418.1

[56] References Cited

U.S. PATENT DOCUMENTS

| | | | |
|---|---|---|---|
| 1,786,917 | 12/1930 | Oehmichen | 28/194 X |
| 2,689,393 | 9/1954 | Duryee | 28/194 X |
| 3,533,543 | 10/1970 | Wenger | 28/194 X |
| 3,580,444 | 5/1971 | Van Mullekom | 28/194 X |
| 3,777,959 | 12/1973 | Seney | 28/194 X |
| 4,525,905 | 7/1985 | Bogucki-Land | 28/194 X |
| 4,744,394 | 5/1988 | Lincke | 66/132 R X |
| 5,176,334 | 1/1993 | Dreschau et al. | 226/44 X |

FOREIGN PATENT DOCUMENTS

| | | | |
|---|---|---|---|
| 2009327 | 9/1971 | Germany | 226/44 |
| 4011039 | 1/1992 | Japan | 28/194 |

*Primary Examiner*—John J. Calvert
*Attorney, Agent, or Firm*—Omri M. Behr; Matthew J. McDonald

[57] ABSTRACT

Arrangement (15) for adjusting the tension of a thread which is pulled from a spool by means of a thread take-off arrangement, has a thread measuring device (23). This thread measuring device, positioned sequentially in the direction of thread travel, can determine thread tension. Also included is a driven drum (17) whose effective circumferential speed is alterable in the same sense as the measured thread tension. In this manner, it is possible to achieve very small thread tensions.

14 Claims, 2 Drawing Sheets

ARRANGEMENT FOR SETTING THE TENSION OF A THREAD

BACKGROUND OF THE INVENTION

1. Field of the Invention

The present invention is directed to an arrangement for adjusting the tension of a thread which may be drawn from a spool by means of a thread take-off arrangement.

2. Description of Related Art

In the known arrangement of this type (DE PS 30 25 765) the control of the thread tension results from an adjustable thread brake whose frictional force may be changed in conjunction with a measuring arrangement for the thread tension placed downstream of the brake. When the measured thread tension rises, the braking action is reduced. Such arrangements are used, for example, in warping machines but also play a role in other textile machine, for example twisting machine and circular knitting machines.

German Patent Application DE OS 30 01 069 discloses a thread provision and control arrangement for a needle weaving machine for bands or similar machines wherein the threads to be processed are subjected to a weft thread tensioning cycle. For this purpose, the threads are led over thread tensioning arrangement in the form of a brake, a drum driven at a constant rate of revolution and the eyelet of a spring biased arm. In the absence of thread tension, the spring loaded arm deviates whereby the threads are brought under a clamping plate. This has the effect that the threads are no longer driven by the drum.

In warping machines, beaming machines, and other winding machines, it is customary to pull off a large number of threads often several hundred threads from spools on a creel at the same time and wind them together, wherein the thread tension for all the threads should be substantially the same and the time of winding should be substantially constant. For this reason, a thread brake is provided for each spool.

It has already been shown that in the utilization of the known friction brake, a relatively hard wind body is provided. Where thin threads are used, the danger of thread breaks exists. This is particularly true when higher warping speeds are desired (for example instead of the previous 600 meters per minute, now 1500 meters per minute). Similar disadvantages which occur because of high thread tension also occur with other textile machines.

The problem to be solved by the present invention is to provide an arrangement of the prior art which can also be utilized with a drive having a lower level of thread tension.

SUMMARY OF THE INVENTION

In accordance with illustrative embodiments demonstrating features and advantages of the present invention, there is provided an arrangement for adjusting tension of a thread with a thread measuring means and a driven means. The thread is taken from a spool and delivered to a thread take-off arrangement. The thread measuring means is located between the spool and the thread take-off arrangement for measuring thread tension. The driven means is coupled to the thread measuring means, for providing a surface having an effective circumferential speed. This effective circumferential speed is variable by the thread measuring means to affect thread tension in a direction measured by the thread measuring means.

In the preferred embodiment apparatus is located between the spool and the thread take-off arrangement in the thread running direction. This apparatus employs thread tension measuring system and a driven means having a drum whose effective circumferential speed is alterable in the same direction as the measured thread tension.

In this arrangement the thread tension is not altered by friction but rather by a positive drive. Since the preferred measuring means is upstream of the drum, the tension raising action of the threads running off the drum s irrelevant. Hence, the tension of these threads which run off can be held much lower than before. This reduced thread tension leads to a softer wind during warping. Furthermore, the danger of breaking of thin threads during their processing, for example during winding, is much reduced.

Similarly, in a warping machine one can reduce the thread tension at the drum output of a regulating arrangement, at a thread speed of 1000 meters per minute, down to 8 to 12 grams. While the thread on the way to the warping drum is under additional load, for example during its passage through the warping reed, through turning points, and the like, nevertheless the thread tension during winding can in fact be reduced to about 20 grams.

By provision of the measuring means in the thread run direction upstream of the drive drum, one is substantially able to measure the input thread tension between the spool and the drum. This increases with decreasing diameter of the spools in the creel. By appropriate changes in the effective circumferential speed of the drum, this tension is reduced. Thus the work of the thread take-off arrangement, for example the shearing drum, as desired, can proceed with a rather lower level of tension. It is only necessary to provide small changes in circumferential speed in order to achieve the desired effect. For example it is merely necessary to stay within a control range of 2% of the nominal circumferential speed.

In some cases it is desirable that a braking means be provided upstream from the measuring means. This braking means exercises an additional small force on the thread and can be put into operation if, otherwise, the thread tension was so small that the threads would no longer be carried along by the drum surface.

In a preferred embodiment the drum is provided with a conical surface and is drivable by a motor at a constant rate of rotation, and is further provided with a thread transport means which is displaceable in dependence upon the thread tension and which displaces the thread running onto the drum in the direction of the drum axis. When the measured thread tension rises, the thread fed to the drum is displaced to the drum segment of larger diameter and is driven correspondingly faster. Thus, the tension increases before the drum is compensated out.

It is particularly desirable if the thread transport means form the thread take-off mechanism of the measuring means and a lever is provided which is biased against the thread force by a spring. By the combination of thread transport means and the measuring means there is provided a rather simple construction with rather few parts. This permits considerable savings, in particular with a spool creel which requires the provision of several hundred of these.

Further advantages are obtained when there are utilized many spools and their corresponding measuring means and drum with a conical surface, and a motor with constant rate of revolution is provided to drive a plurality of drums. Thus, it is sufficient to provide a spool creel with one or just a few motors. This is possible since all of the drums are driven at the same rate of revolution. Nevertheless, it is possible to provide individual biasing for each spool.

In an alternate embodiment, the drum may have a cylindrical surface and be driven by a motor at a rate of revolution dependent upon the thread tension. Such motors with controllable rates of revolution are available in a plurality of different modes of construction; for example, synchronous motors with variable frequency, reluctance motors or synchronous motors.

Preferably, the motor has a load dependent slip and is provided with a brake adjustable in dependence upon the thread tension. Such a slip control is sufficient since only minimal deviations from the nominal rate of revolution are necessary.

In yet another embodiment employing a plurality of spools with corresponding measuring means and drum, the nominal rate of revolution of all drums can be altered at the same time. In this manner, the thread tension can be altered during winding, for example in order to make desired corrections in the wind. In all cases, it is possible, by adjustment of the nominal rate of revolution, to achieve the desired thread tension during the warping procedure and with the assistance of the appropriate arrangement maintain the correct thread tension for each thread.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention, when taken in conjunction with the accompanying drawings wherein.

DETAILED DESCRIPTION OF THE PREFERRED EMBODIMENTS

Figure 1:
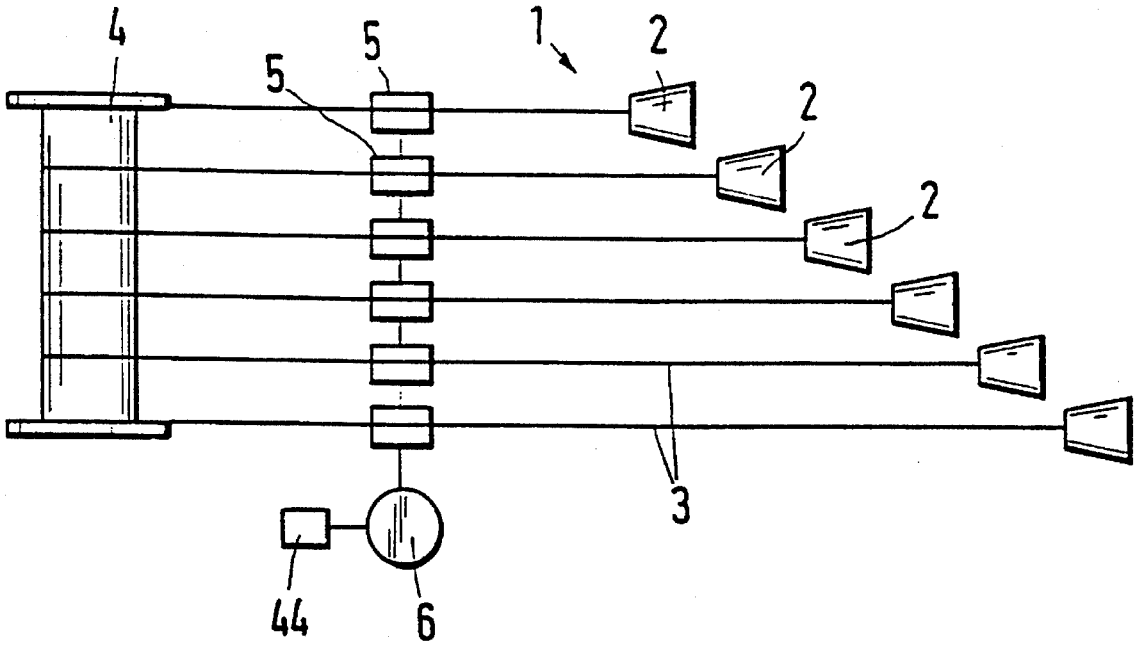
FIG. 1 is a schematic representation of a spool creel in which the arrangement of the present. invention may be utilized.

FIG. 1 schematically illustrates a spool creel 1 having a plurality of spools 2 from which threads 3 are pulled off by a thread take-off arrangement 4, here in the form of a warping drum. In spool creel 1, each thread runs over an arrangement 5, which ensures that all threads running to the thread take-off arrangement 4 run at the same thread tension. A synchronous motor 6 is commonly provided to all of the arrangements 5 in order to drive their drums, as described hereinafter.

Figure 2:
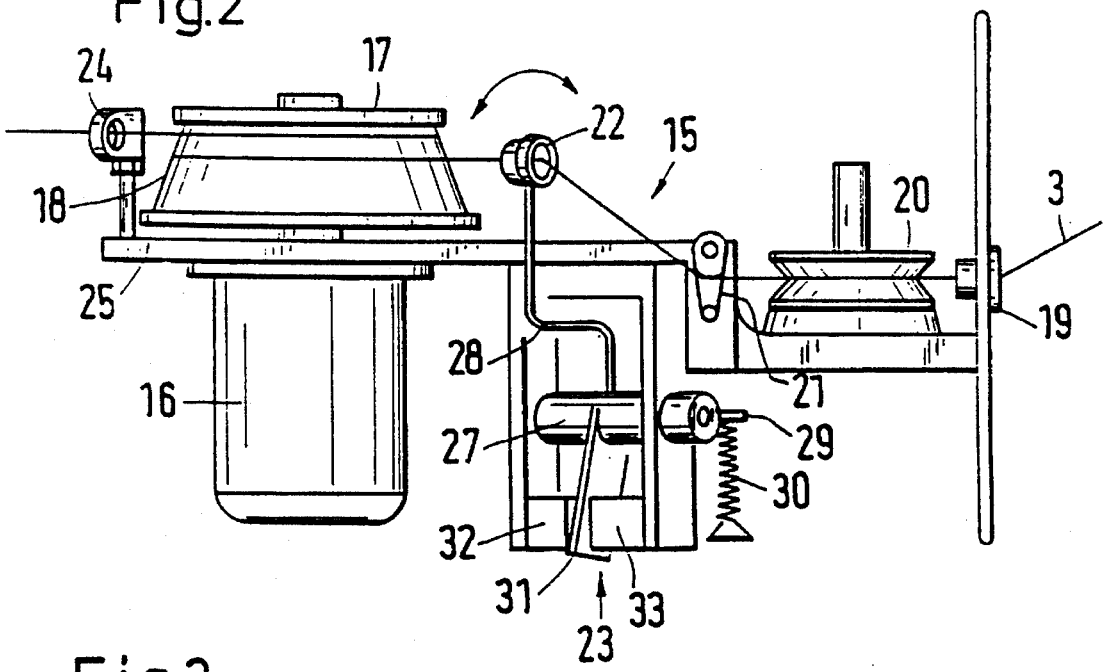
FIG. 2 is a side elevational view of a disclosed arrangement for setting the thread tension.
Figure 3:
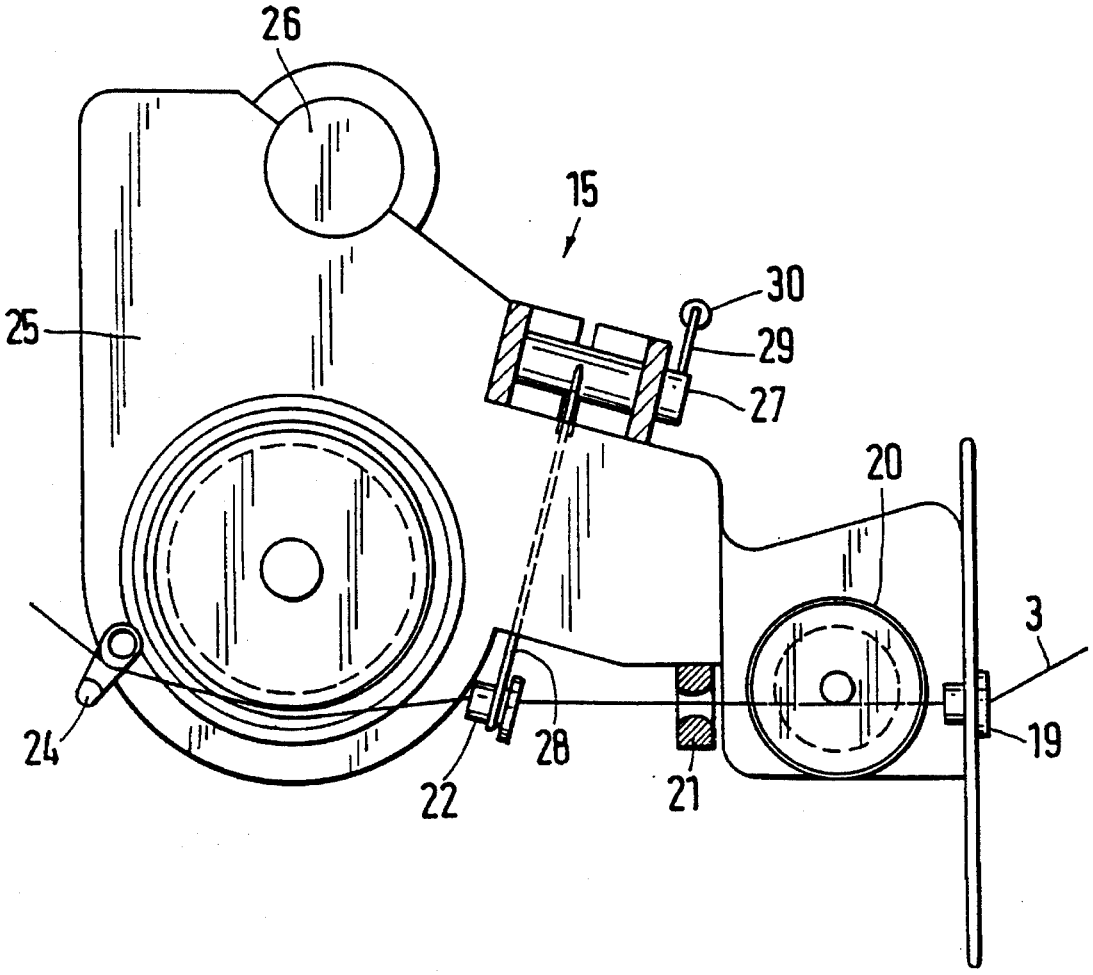
FIG. 3 is a plan view of the arrangement of FIG. 2.

Referring to FIGS. 2 and 3, the arrangement 15 can regulate thread tension and comprises its own synchronous motor 16 which drives a drum 17 provided with a conical surface 18 at a constant rate of revolution. This motor and drum are referred to as a driven means. There is a correspondence between arrangements 5 and 15.

A thread 3 is led through eyelet 19 and prior brake 20, through a turning eyelet 21 and the thread take-up arrangement 22 (also referred to as a transport means) of a thread measuring means 23 (also referred to as a thread measuring device). As described further hereinafter thread measuring device 23 operates to regulate thread tension. Thread 3 is then fed to drum 17 and after one or two loops around the drum, is further led to the thread take-up arrangement 4 via fixed eyelet 24. A carrier 25 which is attached to a column 26 of the creel, carries the motor 16 as well as: the bearing for drum 17, measuring means 23, the prior brake 20, and all guide means.

The measuring means 23 comprises rod 27, which supports a lever 28 that carries at its free end the thread take-up arrangement 22 of the measuring means 23. Spring 30 is attached to another lever arm 29 for biasing the axis 27 in a direction to oppose thread tension.

Furthermore axis 27 carries a copper fish plate 31 which is movable between two permanent magnet poles 32 and 33, so that an eddy current damping means against strong deviations is generated. The bearing of axis 27 is so provided that the deviation of the thread take-up arrangement 22 has a component of motion parallel to the axis of drum 17. This take-up arrangement 22 forms, at the same time, a thread transport means, which can displace the thread along the conical surface 18 of the drum 17.

There is thus obtained the following mode of action. The thread 3 coming from spool 2 has an input thread tension which is determined by means of the measuring means 23. The resulting position of the thread take-up arrangement 22 is determined by the counterforce of spring 30. When the input thread tension increases, the lever 28 is displaced together with a thread take-up arrangement 23. The result of this is that the thread 3 looped around the drum 17 is displaced into a region of surface 18 having a larger diameter with the result that it is provided to the thread take-up arrangement 4 at a higher velocity. This in turn leads to a reduction of the output thread tension between the drum 17 and the thread take-up arrangement 4. Thus, the thread tension effective before the drum is thus reduced or compensated. This is also true of the effect of the prior brake 20 which is only put into operation when the thread tension is so small that it is necessary to ensure a reliable drive of the thread 3 from the drum 17.

It is to be noted that the pitch of the surface 18 in the illustration is substantially exaggerated. In actuality the difference in the diameter between one end and the other is only a few percent, for example 2%. Since each input tension requires a particular setting of the thread take-up arrangement 22, the output tension of thread 3 is also determined. In order to operate with substantially constant thread tension it is generally speaking sufficient to utilize a simple conical form. For more stringent requirements, it is possible to utilize a corrected conical form, which does not have the same pitch throughout.

Figure 4:
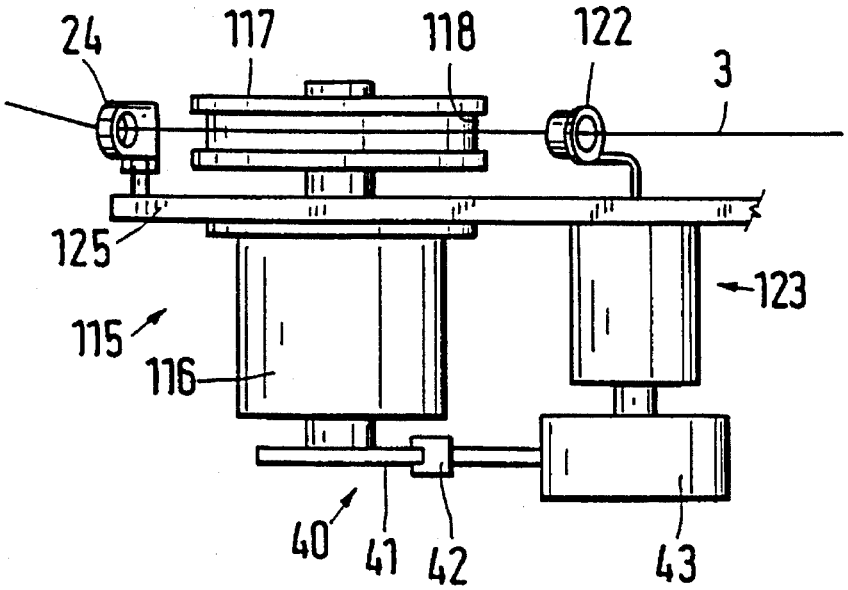
FIG. 4 is a schematic representation of another embodiment in side elevational view.

Referring to FIG. 4, in the arrangement 115 for adjusting thread tension, identical parts bear the same reference numeral, while corresponding parts bear reference numerals that are raised by 100. The drum 117 has a cylindrical surface 118 and is driven by an asynchronous motor 116. This asynchronous motor 116 has a brake 40 which, in the illustrated embodiment, comprises a braking disk 41 with a braking shoe 42. An activating means 43 exercises a force working on brake shoe 42, by which the motor 116 is biased and can take on a greater slip.

A measuring means 123 carries a deflectable thread up-take means 122, which on the one side is biased by the thread tension and on the other by a spring (not illustrated) and thus takes up a particular deviated position. In dependence upon the deviated position, a signal is generated by measuring means 123 to the activating means 43 which releases the appropriate braking force. In this way, the turning rotational speed of the drum 117 (that is to say, the effective circumferential speed) is directly related to the deviation of the thread take-up arrangement 122. The drive means corresponds to that illustrated in FIGS. 2 and 3.

When the tension of all of the threads 3 which are to be wound is to be altered together, the predetermined rate of revolution of the motor or motors can be changed. In the embodiment of the example of FIG. 1 the synchronous motor 6 is provided with a frequency generator 44 and by means of changing frequency the number of rotations is changed.

We claim:

1. Arrangement for adjusting tension of a thread taken from a spool and delivered to a thread take-off arrangement, comprising:

a thread measuring means located between said spool and said thread take-off arrangement for measuring thread tension; and a driven means coupled to said thread measuring means and located downstream of said thread measuring means and upstream of said thread take-off arrangement, for providing a surface having an effective circumferential speed, and being operable to increase or decrease said circumferential speed, in response to thread tension upstream of said driven means respectively increasing or decreasing whereby the thread tension downstream of said driven means is correspondingly decreased or increased.

2. Arrangement in accordance with claim 1 comprising:

a braking means located upstream of said thread measuring means for tensioning the thread.

3. Arrangement in accordance with claim 1 wherein said driven means comprises:

a motor having a constant rotational speed;

a drum coupled to and driven by said motor and having a conical surface and a drum axis; and a thread transport means for displacing the thread running on the drum with a component of motion parallel to the drum axis, said thread transport means being operable in dependence upon thread tension.

4. Arrangement in accordance with claim 3 comprising:

a braking means located upstream of said thread measuring means for tensioning the thread.

5. Arrangement in accordance with claim 4 wherein the thread transport means comprises:

a spring biased lever coupled to, and operable to be rotated by, said thread measuring means in response to thread tension; and a thread take-up arrangement mounted on said lever for guiding said thread onto said drum.

6. Arrangement in accordance with claim 1 wherein said spool comprises a plurality of spools, said thread measuring means comprising a plurality of thread measuring devices, said driven means comprising: a plurality of frustro-conical drums each operatively associated with a different corresponding one of said thread measuring devices; and a common motor providing a constant rate of revolution for driving said plurality of drums.

7. Arrangement in accordance with claim 6 wherein said driven means comprises:

a motor having a constant rotational speed;

a drum coupled to and driven by said motor and having a conical surface and a drum axis; and a thread transport means for displacing the thread running on the drum with a component of motion parallel to the drum axis, said thread transport means being operable in dependence upon thread tension.

8. Arrangement in accordance with claim 7 wherein the thread transport means comprises:

a spring biased lever coupled to, and operable to be rotated by, said thread measuring means in response to thread tension; and a thread take-up arrangement mounted on said lever for guiding said thread onto said drum.

9. Arrangement in accordance with claim 1 wherein the driven means comprises:

a drum having a cylindrical surface; and a motor coupled to said drum for driving it at an adjustable rate of revolution which varies in response to thread tension measured by said thread measuring means.

10. Arrangement in accordance with claim 9 comprising:

a braking means located upstream of said thread measuring means for tensioning the thread.

11. Arrangement in accordance with claim 9 wherein the motor has a load dependent slip, said driven means comprises:

a brake coupled to said motor and adjustable in response to thread tension measured by said thread measuring means.

12. Arrangement in accordance with claim 1 wherein said spool comprises a plurality of spools, said thread measuring means comprising a plurality of thread measuring devices, said driven means comprisings a plurality of drums each operatively associated with a different corresponding one of said thread measuring devices, said drums having a rotational speed that is simultaneously adjustable, so that all drums can be commonly adjusted.

13. Arrangement in accordance with claim 12 comprising:

a braking means located upstream of said thread measuring means for tensioning the thread.

14. Arrangement in accordance with claim 12 wherein said driven means comprises:

a motor having a constant rotational speed;

a drum coupled to and driven by said motor and having a conical surface and a drum axis; and a thread transport means for displacing the thread running on the drum with a component of motion parallel to the drum axis, said thread transport means being operable in dependence upon thread tension.

* * * * *